United States Patent [19]

Daviddi

[11] Patent Number: 4,887,497

[45] Date of Patent: Dec. 19, 1989

[54] BOTTLE CORK REMOVER

[76] Inventor: Neo Daviddi, 15244 Michigan Ave., Dearborn, Mich. 48126

[21] Appl. No.: 292,451

[22] Filed: Dec. 30, 1988

[51] Int. Cl.[4] ..... B67B 7/06

[52] U.S. Cl. ..... 81/3.37; 81/3.56

[58] Field of Search ..... 81/3.08, 3.33, 3.36, 81/3.37, 3.29, 3.4, 3.56

[56] References Cited

U.S. PATENT DOCUMENTS

| | | | |
|---|---|---|---|
| 747,351 | 12/1903 | Armstrong | 81/3.37 |
| 4,527,450 | 7/1985 | Drosky | 81/3.56 X |
| 4,680,993 | 7/1987 | Feliz | 81/3.29 X |
| 4,756,214 | 7/1988 | Valtri et al. | 81/3.4 |

*Primary Examiner*—D. S. Meislin

*Attorney, Agent, or Firm*—Charles W. Chandler

[57] ABSTRACT

A mechanism for removing a cork from a champagne bottle, wherein a manual force is applied along the bottle axis, so as to avoid side thrust forces that might cause the bottle to slip out of the person's hand. A lazy tong linkage is utilized to apply a magnified force onto the undersurface of the cork, whereby the person is able to exert a smooth controlled manual force on the mechanism, as opposed to a massive abrupt force that might tend to cause the bottle to drop or tip over.

7 Claims, 1 Drawing Sheet

BOTTLE CORK REMOVER

BACKGROUND OF THE INVENTION

This invention relates to a bottle cork remover, especially a cork remover for use on champagne bottles. In some respects the cork remover is similar to the cork remover shown in U.S. Pat. No. 4,257,450 issued to B. Drosky.

U.S. Pat. No. 4,257,450 shows a cork remover that comprises a cork lifter sleeve 6 slideably positioned within a cylindrical housing 4; the sleeve has an inturned flange at its lower end adapted to underlie a cork on a champagne bottle.

In the arrangement of U.S. Pat. No. 4,527,450 a rockable puller mechanism 8 has a cam-type engagement on a top wall 16 of housing 4. An axial stem member 28 extends upwardly through wall 16 for pivotal connection with mechanism 8. To remove a cork from a bottle, the puller mechanism 8 is rocked around its pivotal connection point with stem member 28. The rocking motion enables the cam portion 42 of mechanism 8 to exert a cam force on housing top wall 16, thereby causing stem member 28 and the associated lifter sleeve 6 to pull the cork out of the bottle.

The rocking motion of puller mechanism 8 in the Drosky apparatus, is somewhat disadvantageous in that a side thrust is applied to housing 4 at housing top wall 16. The person using the apparatus is required to make a positive conscious manual effort to counteract this side thrust; otherwise the bottle may slip out of the person's hand.

Also, the side thrust produced during use of the Drosky apparatus may dislodge the cork remover mechanism from the bottle, especially if the mechanism is only loosely held or retained on the bottle during the initial stage of the cork opening process.

SUMMARY OF THE INVENTION

My invention relates to a bottle cork remover wherein the puller mechanism moves axially and upwardly during the cork-removing operation. The aim is to avoid the side thrust that I believe is a disadvantageous characteristic of the device shown in U.S. Pat. No. 4,527,450.

A primary object of my invention is to provide a cork remover that can be safely used, without special advance knowledge on the part of the person using the cork remover mechanism.

Another object of my invention is to provide a cork remover wherein the component parts are firmly and rigidly connected together whereby the cork remover mechanism has a relatively long service life, even when subjected to some abuse.

A further object of my invention is to provide a cork remover having an outer housing that has smooth continuous surface contours devoid of abrupt shoulders that could detract from the appearance of the housing or form dirt collection zones.

THE DRAWING

FIG. 1 is a sectional view taken through a bottle cork remover mechanism constructed according to the teachings of my invention;

FIGS. 2, 3 and 4 are sectional views taken respectively on lines 2—2, 3—3 and 4—4 in FIG. 1; and FIG. 5 is an enlarged sectional view of a structural detail used on the FIG. 1 mechanism.

DESCRIPTION OF THE PREFERRED EMBODIMENT

Figure 1:
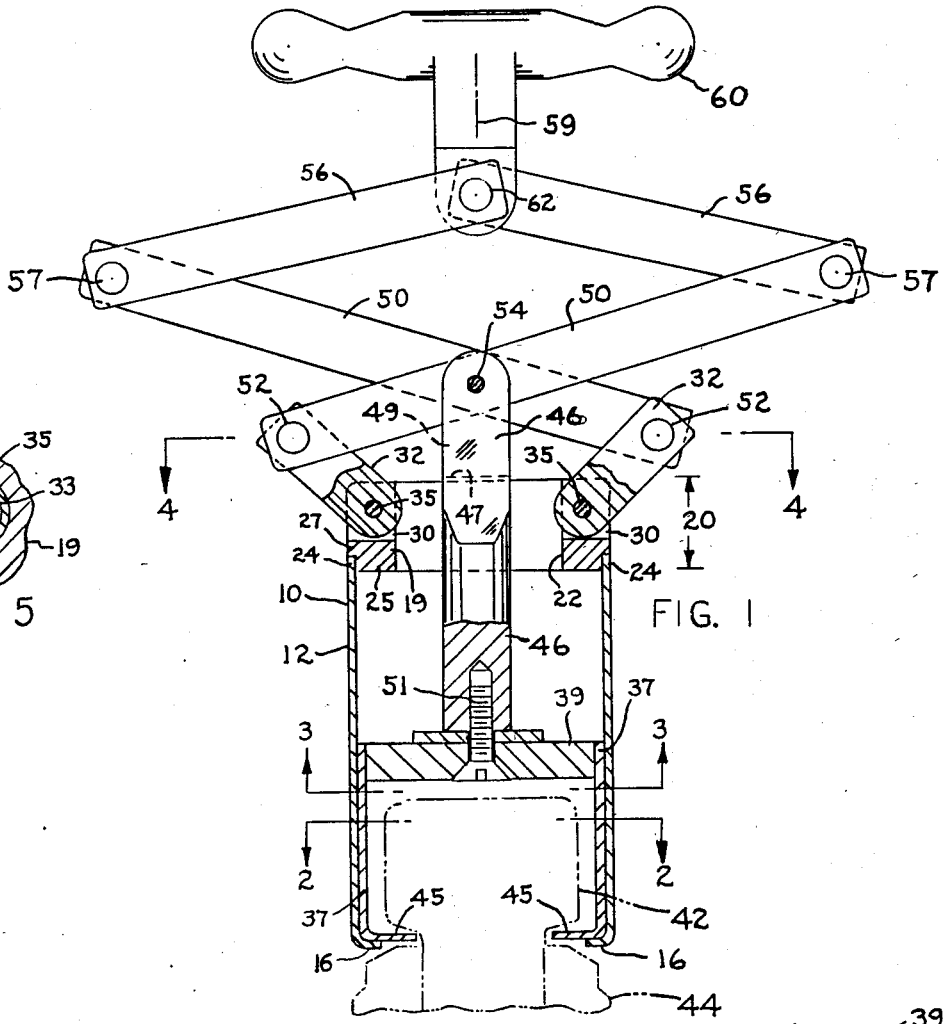
Figure 2:
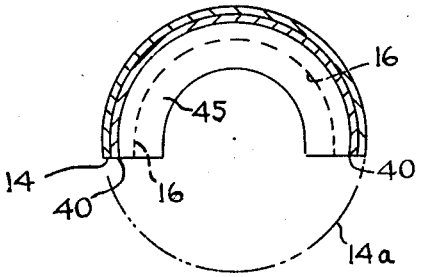
Figure 3:
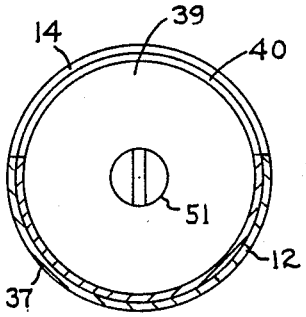

FIG. 1 illustrates a preferred form that the invention can take. The mechanism comprises a cork remover housing 10 that includes a tubular cylindrical side wall 12 having a side opening 14. The side opening extends upwardly from the lower end of wall 12 to a point just above section line 3—3 of FIG. 1. Opening 14 extends around for a distance slightly less than one half of the circumference of wall 12.

At its lower end, wall 12 has an integral, inturned flange 16 extending therearound. The term "integral" is here used to mean that the flange is formed from the same piece of material as tubular wall 12, as opposed to being a separate member welded or otherwise attached to wall 12. The integral construction of wall 12 and flange 16 gives the housing a smooth seamless outer surface contour.

At its upper end, wall 12 is connected to an axially thickened annular top wall 19. Numeral 20 in FIG. 1 illustrates the thickness dimension of top wall 19. The inner peripheral edge surface on wall 19 is denoted by numeral 22. Wall 19 is recessed around its peripheral edge, as at 24 in FIG. 1, such that the extreme lower end portion of the wall forms a cylindrical plug 25. The upper end section of wall 12 has a press fit on cylindrical plug section 25, whereby the side wall and top wall are firmly and rigidly connected together to withstand any reasonable force exerted thereon during service. The outer peripheral surface 27 of top wall 19 forms a smooth continuation of the tubular side wall surface.

Two aligned radial slots 30 are cut into the upper surface of axially thickened wall 19 to accommodate two external swingable links 32. Two small diameter holes 33 are drilled through wall 19 across slots 30. Roll pins 35 are pressed or otherwise driven into holes 33 (with links 32 positioned in slots 30), such that pins 35 form pivotal connections between wall 19 and the two links 32.

Figure 4:
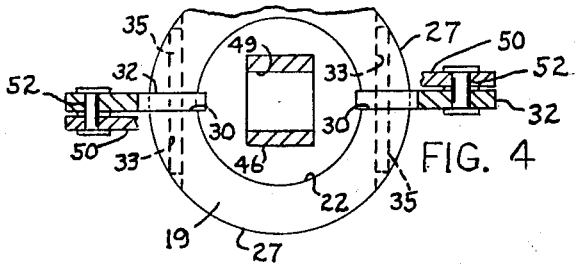
Figure 5:
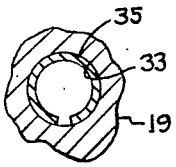

The construction of each roll pin 35 is best seen in FIG. 5. Each roll pin is a circular C-shaped strip of spring steel sized to tightly fit into the associated hole so as to exert an expansive force on the hole surface. The outer surface of each pin is a relatively hard surface adapted for long wear under frictional loadings imposed by links 32. FIG. 4 illustrates the length of each roll pin 35. Each roll pin is slightly shorter than the axial dimension of each associated hole 33, whereby the pins are located within the circular plan dimension of wall 19. The pins do not extend beyond peripheral surface 27 of wall 19. The pins do not form undesirable projections or obstructions.

Returning to FIG. 1, there is shown therein a cylindrical sleeve 37 slidably disposed within tubular housing wall 12. A top plate 39 extends across the upper end of the sleeve as a press fit therein.

Plate 39 is axially thickened so that its peripheral edge surface will have the necessary surface area to achieve a high interference fit in sleeve 37.

Sleeve 37 has a side opening 40 aligned with side opening 14 in wall 12. The two openings are similar in size, both axially and circumferentially, such that a cork of a bottle can be located within the space circumscribed by sleeve 37. FIG. 1 shows in dashed lines a cork 42 located within sleeve 37. The associated champagne bottle 44 has its upper edge surface located below the aforementioned flange 16 on wall 12.

At its lower end, sleeve 37 has a second inturned flange 45. When the mechanism is inserted onto the cork of a champagne bottle, flange 45 underlies the protruding section of the cork. Subsequent upward movement of sleeve 37 causes flange 45 to push the cork out of the bottle. Housing flange 16 seats against the upper edge surface of the bottle to absorb the vertical thrust force.

A puller shaft 46 extends upwardly from plate 39 through the central space defined by annular housing top wall 19. The upper end section of shaft 46 has a rectangular cross-section, as shown for example in FIG. 4. A transverse slot 49 extends through the upper section of shaft 46 down to a point designated by numeral 47 in FIG. 1. Slot 49 accommodates therein two crossed links 50, that form parts of a lazy tong puller linkage.

Shaft 46 is detachably connected to plate 39, as for example by means of screw 51. Screw 51 extends upwardly through plate 39 into a threaded hole in the lower end of shaft 46. During assembly of the mechanism at the factory, the assembly of sleeve 37 and plate 39 is installed into tubular side wall 12 prior to installation of top wall 19 into wall 12 (by a press fit operation). The external lazy tong puller linkage may be connected to wall 19 puller shaft 46 before, or after, wall 19 is connected to tubular wall 12. Screw 51 is threaded into shaft 46 after shaft 46 is in position within housing 10.

The above-mentioned lazy tong linkage comprises the two links 32 and the two additional links 50. Links 50 are pivotally connected to the outer free ends of links 32, as at 52. Links 50 extend through slot 49 in shaft 46 in crossing relation. A pivot mechanism 54 is extended through puller shaft 46 and the two links 50 at the point where the two links cross one another. Pivot mechanism 54 is preferably a roll pin similar to the roll pin shown in FIG. 5.

The lazy tong linkage further comprises two other links 56 that are pivotably connected to the other free ends of links 50, as at 57. Links 56 extend angularly toward each other to overlap at an imaginary point along the puller shaft axis 59. A handle structure 60 is pivotably connected to links 56 at the point where they overlap one another. The pivotable connection 62 may be a flanged pin similar to the flanged pins 52 shown in FIG. 4. Handle structure 60 is formed with flat surfaces at its lower end, whereby the lower end section of the handle structure is located between the opposed surface areas of links 56.

Each of the various links 32, 50 and 52 is a flat bar having a rectangular cross section, whereby the opposed surface areas of the overlapping bar areas are parallel and flat. At pivotal connections 52, 57 and 62, flat washers are arranged between the flat surface of the bars to minimize frictional drag and otherwise to promote a smooth easy motion of the lazy tong mechanism.

The links in the lazy tong mechanism are sized (as to length) so that the motion of handle 60 along axis 59 is substantially greater than the motion of lifter sleeve 37. For example, sleeve 37 may have a motion stroke of about 1 inch, whereas the motion stroke of handle 60 is about 3¼ inches. This results in a force multiplication between the handle and the sleeve, such that a relatively small upward pulling force on the handle results in a substantially greater application of force onto the underside of cork 42. The person using the mechanism is able to exert a controlled force on handle 60, rather than an abrupt massive effort that might tend to jerk the cork out of the bottle so as to cause the bottle to slip out of a person's grasp.

The mechanism is operated with a straight upward pull force on handle 60. Therefore the mechanism does not produce the side thrust force that is associated with operation of the mechanism shown in aforementioned U.S. Pat. No. 4,527,450.

The use of lazy tong devices in cork remover devices is already known, as for example in U.S. Pat. No. 747,351 to H. Armstrong. My lazy tong mechanism is believed to be an improved mechanism in that links 32 of the mechanism are located in slots in a thickened annular top wall of a mechanism housing. The pivotal connections 35 provide strong firm connection points between the lazy tongs and the housing structure. Also, in my lazy tong construction, links 50 extend through a slot 49 in puller shaft 46, such that links 50 are symmetrically positioned relative to the shaft 46 axis. In this connection, handle 60 is symmetrically positioned relative to the shaft 46 axis, so that all of the manual force is along the shaft axis (not offset from the shaft axis).

The drawings show one specific form that the invention can take. Other forms are possible.

I claim:

1. A bottle cork remover comprising:

a housing that includes a tubular cylindrical side wall having a side opening therein and a first inturned flange at its lower end adapted to seat against the upper edge surface of a bottle, and an axially thickened annular top wall extending across the upper end of the tubular side wall and defining a central space;

a lifter element that includes a sleeve slideably disposed within the tubular side wall for vertical reciprocatory movement, and a top plate connected to and extending across the upper end of the sleeve within the space circumscribed by the tubular wall; said sleeve having a side opening therein aligned with the side opening in the tubular wall to enable the sleeve to fit around a cork on a bottle; said sleeve having a second inturned flange at its lower end adapted to underlie a cork on a bottle;

a puller shaft connected to and extending upwardly from the sleeve top plate through the central space defined by the housing top wall so as to be movable with said sleeve;

two aligned radial slots in the upper surface of said axially thickened top wall;

and an external lazy tong mechanism connected to the housing and the puller shaft for applying a magnified manual force to the lifter element to move the lifter element with respect to said housing;

said lazy tong mechanism comprising two lazy tong links extending into the radial slots in the housing top wall, and pivot pins extending horizontally through the housing top wall and across the radial slots to form pivot connections for the respective lazy tong links.

2. The cork remover of claim 1, wherein the pivot pins are elongated roll pins extending through circular holes in the housing top wall; each roll pin being a circular C-shaped strip of spring steel sized to exert an expansive force on the associated hole surface.

3. The cork remover of claim 1, wherein the puller shaft has a transverse slot formed therein;

said lazy tong mechanism further comprising two additional links having pivotable connections with the free ends of the first-mentioned links; said two additional links extending through the slot in the puller shaft in a crossing relationship;

and a pivot mechanism extending through the puller shaft and the two additional links at the point where the two additional links cross one another within the slot in the puller shaft.

4. The cork remover of claim 2, wherein the lazy tong mechanism further comprises two other links pivotably connected with the free ends of the two additional links; said two other links extending angularly toward each other to overlap at an imaginary point on the puller shaft axis; and a handle pivotably connected to said two other links at the point where they overlap one another.

5. The cork remover of claim 1, wherein the lower end portion of the thickened annular top wall is recessed around its peripheral edge to the depth of the side wall thickness, whereby said lower end portion defines a cylindrical plug; said tubular side wall having a press fit on said cylindrical plug whereby the outer peripheral surface of the annular top wall forms a smooth continuation of the tubular side wall surface.

6. The cork remover of claim 5, wherein the first inturned flange is integral with the tubular side wall.

7. The cork remover of claim 1, and further comprising a screw extending through said top plate into a threaded opening in the lower end of the puller shaft, whereby said shaft is detachably connected to the lifter element.

* * * * *